US006379198B1

(12) United States Patent
Arnett et al.

(10) Patent No.: US 6,379,198 B1
(45) Date of Patent: Apr. 30, 2002

(54) ELECTRICAL CONNECTOR TERMINAL CONSTRUCTION

(75) Inventors: Jaime Ray Arnett, Fishers, IN (US); Michael Gregory German, Secaucus, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/524,654

(22) Filed: Mar. 13, 2000

(51) Int. Cl.[7] ..... H01R 13/05; H01R 4/24; H01R 4/26; H01R 11/20

(52) U.S. Cl. ..... 439/825; 439/404

(58) Field of Search ..... 439/404, 405, 439/79, 82, 825, 692, 884

(56) References Cited

U.S. PATENT DOCUMENTS

| | | | | | |
|---|---|---|---|---|---|
| 3,223,960 | A | | 12/1965 | Ruehlemann | |
| 3,663,930 | A | * | 5/1972 | Henschen et al. | 439/660 |
| 4,206,964 | A | | 6/1980 | Olsson | |
| 4,533,200 | A | | 8/1985 | Wilson | |
| 5,207,603 | A | * | 5/1993 | Peloza | 439/824 |
| D354,268 | S | | 1/1995 | Siemon | |
| 5,630,720 | A | | 5/1997 | Kocher | |
| 5,645,445 | A | | 7/1997 | Siemon | |
| 6,000,973 | A | * | 12/1999 | Mitra | 439/825 |
| 6,050,842 | A | * | 4/2000 | Ferrill et al. | 439/404 |
| 6,093,048 | A | | 7/2000 | Arnett | |

* cited by examiner

*Primary Examiner*—Brian Sircus
*Assistant Examiner*—Chandrika Prasad
(74) *Attorney, Agent, or Firm*—Law Office of Leo Zucker

(57) ABSTRACT

An electrical connector terminal has an elongated wire board mounting portion that fits axially in a terminal opening in a wiring board. An elongated, generally planar wire connecting portion has an axis in common with that of the mounting portion and is formed to connect with an outside lead. A shoulder portion between the mounting portion and the wire connecting portion has a first section extending from a base of the wire connecting portion and normally of the wire connecting portion, wherein the terminal is held stable when the first section is restrained by a part outside the plane of the wire connecting portion. A second section of the shoulder portion diverges from an end of the first section and extends parallel to the wire connecting portion. An end of the second section provides a desired coupling with a confronting end of a shoulder portion of a like connector terminal.

13 Claims, 12 Drawing Sheets

ELECTRICAL CONNECTOR TERMINAL CONSTRUCTION

SUMMARY OF THE INVENTION

According to the invention, an electrical connector terminal includes an elongated wire board mounting portion having an axis, wherein the mounting portion is formed to fit axially in a terminal opening in a wire board. An elongated generally planar wire connecting portion has an axis the same as the axis of the mounting portion and is formed to connect electrically with an outside wire lead. A shoulder portion is formed between the mounting portion and the wire connecting portion, wherein the shoulder portion has a first section that extends from a base of the wire connecting portion in a direction normal to the wire connecting portion so that the terminal will be held stably relative to the wire board when the first section of the shoulder portion is restrained by an outside part at a position outside the plane of the wire connecting portion. The shoulder portion also has a second section that diverges from an end of the first section farther from the wire connecting portion, and the second section extends in a direction that is parallel to the wire connecting portion. An end of the second section of the shoulder portion is dimensioned and arranged to provide a desired amount of coupling in association with a confronting end of a second section of a shoulder portion of a like connector terminal.

According to another aspect of the invention, an electrical connector terminal arrangement includes a wire board, and at least a first connector terminal and a second connector terminal mounted on the wire board. Each terminal includes an elongated wire board mounting portion having an axis, wherein the mounting portion is formed to fit axially in a terminal opening in the wire board, an elongated generally planar wire connecting portion having an axis the same as the axis of the mounting portion and formed to connect electrically with an outside wire lead, and a shoulder portion formed between the mounting portion and the wire connecting portion. The shoulder portion has a first section that extends from a base of the wire connecting portion in a direction normal to the wire connecting portion so that the terminal will be held stably relative to the wire board when the first section of the shoulder portion is restrained by and outside part at a position outside the plane of the wire connecting portion, and a second section that diverges from an end of the first section farther from the wire connecting portion, wherein the second section extends in a direction that is parallel to the wire connecting portion. An end of the second section of the shoulder portion of the first terminal is aligned with and spaced from an end of the second section of the shoulder portion of the second terminal to obtain a desired coupling between the first and the second connector terminals.

According to another aspect of the invention, an electrical connector terminal block includes a housing, a wire board supported in the housing, a base wall supported in the housing in the vicinity of the wire board, a first connector terminal, and a second connector terminal mounted on the wire board. Each of the first and the second connector terminals includes an elongated wire board mounting portion having an axis, wherein the mounting portion is formed to fit axially in a terminal opening in the wire board, an elongated generally planar wire connecting portion having an axis the same as the axis of the mounting portion and formed to connect electrically with an outside wire lead, and a shoulder portion formed between the mounting portion and the wire connecting portion. The shoulder portion has a first section that extends from a base of the wire connecting portion in a direction normal to the wire connecting portion, so that the first and the second connector terminals are held stable relative to the wire board when the first section of the shoulder portion of each terminal is restrained by said base wall at a position outside the plane of the wire connecting portion of each terminal. The shoulder portion also has a second section that diverges from an end of the first section farther from the wire connection portion, and the second section extends in a direction that is parallel to the wire connecting portion. An end of the second section of the shoulder portion of the first terminal is aligned with and spaced from an end of the second section of the shoulder portion of the second terminal in such a manner as to obtain a desired coupling between the first and the second connector terminals.

For a better understanding of the invention, reference is made to the following description taken in conjunction with the accompanying drawing and the appended claims.

DETAILED DESCRIPTION OF THE INVENTION

Figure 1:
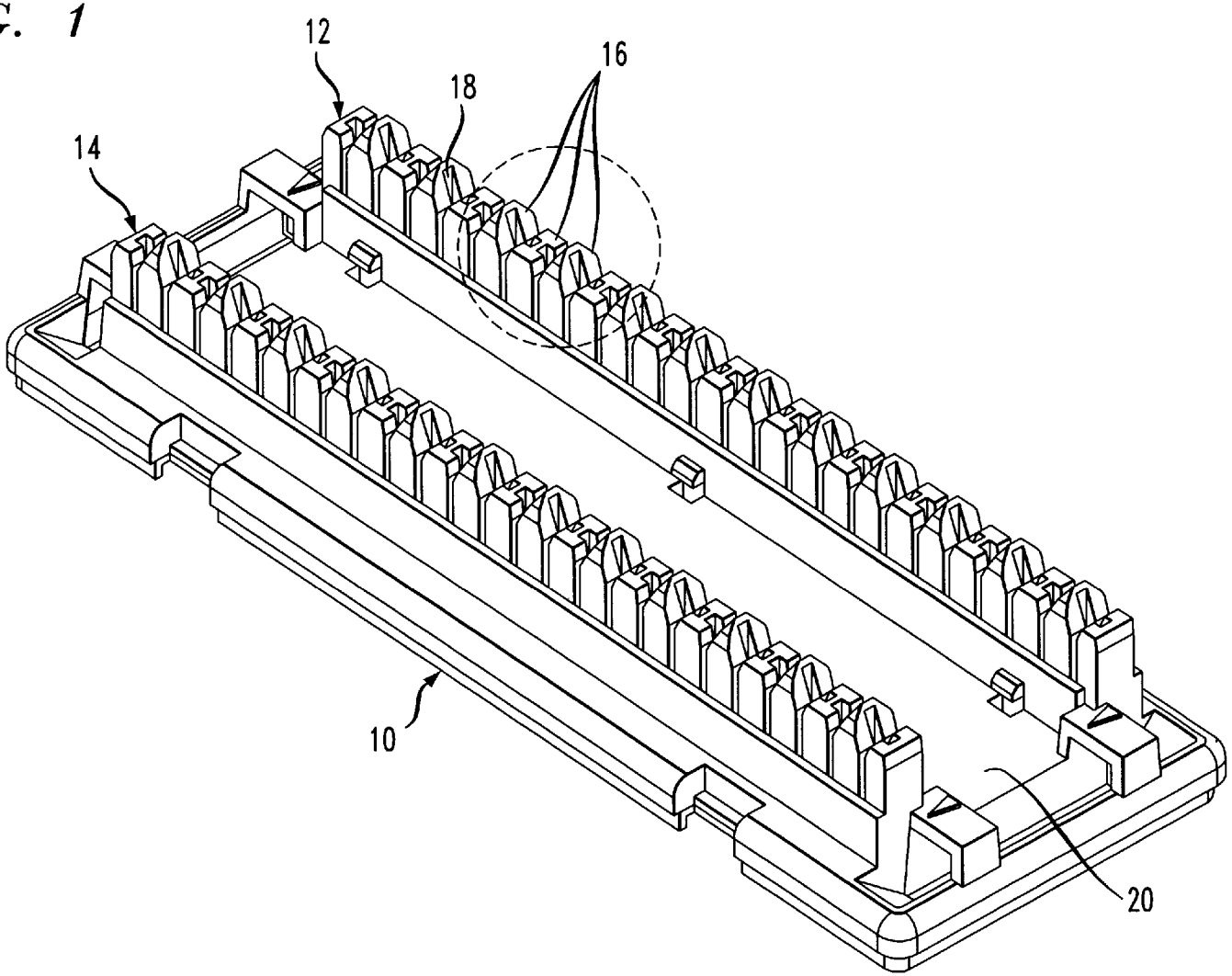
FIG. 1 is a perspective view of an electrical connector terminal housing or block in which connector terminals of the present invention may be used.

FIG. 1 shows an electrical connector terminal housing 10, in which electrical connector terminals of the invention any be assembled. For purposes of illustration and without limitation, the housing 10 surrounds two rows 12, 14 of connector terminals, wherein the terminals are accessible between a number of terminal wire guide posts 16. In the disclosed embodiments, the connector terminals are insulation displacement connector (IDC) terminals. Each IDC terminal has an axially directed vertical slot for receiving one or more outside wire leads, and for cutting through insulation about the leads to establish electrical contact as the leads are urged downward between a pair of the posts 16 and into the terminal slot. Pairs of the posts 16 together define vertical channels 18 within which associated IDC terminals are received and captured. The posts are spaced apart enough to allow outside wire leads to be urged downward between them and into a terminal slot.

The terminal housing 10 contains a printed wire board (not shown in FIG. 1) that is supported within the housing. The electrical connector terminals are mounted on the wire board and are restrained from movement by parts of the terminal housing 10, including, e.g., a base wall 20 of the housing as explained below.

Figure 2:
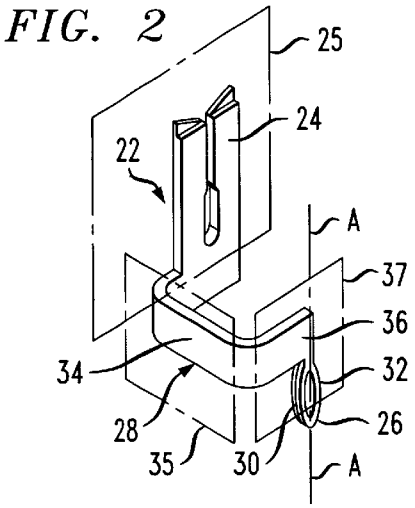
FIG. 2 is a perspective view of a first embodiment of an electrical connector terminal of the invention.

FIG. 2 is a view of a first embodiment of an electrical connector terminal of the invention. In FIG. 2, an electrical connector terminal 22 is formed, e.g., from a sheet of phosphor bronze or beryllium copper, typically about 0.016 inch thick. The terminal 22 has a wire connecting portion 24 which, in the illustrated embodiments, has an insulation displacement connector (IDC) configuration and lies within a plane 25. The wire connecting portion 24 is typically about 0.085 inches wide at the top, and about 0.200 inches overall height.

Terminal 22 also has an elongated, wire board mounting portion 26 having an axis A. In the disclosed embodiments the wire board mounting portion 26 is formed to be press fit axially into a terminal opening in a wire board (not shown in FIG. 2). The mounting portion 26 has two opposed curvilinear sections 30, forming an elongated, open needle-eye configuration about the axis A of the mounting portion. The height of the mounting portion 26 is typically about 0.093 inches, and the width of the mounting portion is typically about 0.036 inches.

A shoulder portion 28 extending from one side of the terminal 22 is formed and dimensioned to project in a direction normal to the plane 25 of the wire connecting portion 24, and to join the wire connecting portion 24 and the mounting portion 26 to one another. In FIG. 2, the shoulder portion 28 is generally C-shaped, as viewed from above, and has sections 34, 36, that extend in planes 35, 37 that are substantially parallel to the axis A of the mounting portion 26. Because part of the shoulder portion 28 (section 34) projects normally of the plane 25 of the wire connecting portion 24, the terminal 22 can be held stably on a wire board to which the terminal 22 is mounted by allowing the shoulder portion including both sections 34, 36 to be restrained by parts of the terminal housing 10, at positions outside the plane 25 of the wire connecting portion 24. See FIG. 8.

In the illustrated embodiment, the shoulder portion 28 projects about 0.150 inches from the wire connecting portion 24. As mentioned, both of the sections 34, 36 of the shoulder portion 28 extend in planes 35, 37 that are substantially parallel to the axis A of the mounting portion 28. Also, while the plane 35 of section 34 is generally perpendicular to the plane 25 of the wire connecting portion 24, the plane 37 of the shoulder portion section 36 is generally parallel to the plane 25 of the connecting portion 24, and the mounting portion 26 is joined at a free end of the shoulder portion section 36.

Figure 3:
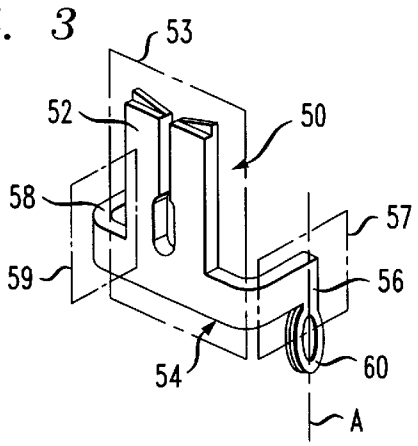
FIG. 3 is a perspective view of a second embodiment of an electrical connector terminal of the invention.

FIG. 3 is a perspective view of a second embodiment of an electrical connector terminal 50, according to the invention. Terminal 50 has a wire-connecting portion 52 which may be formed the same as or similar to the connecting portion 24 in FIG. 2, and which lies within a plane 53. The terminal 50 also has a generally "C"-shaped shoulder portion 54 as viewed from above, with sections 56, 58 that lie in planes 57, 59 that are normal to the plane 53 of the wire connecting portion 52 at either side of the connecting portion. Terminal 50 also has a wire board mounting portion 60, which may be formed the same as or similar to the mounting portion 26 of terminal 22 in FIG. 2. In FIG. 3, shoulder section 56 is joined at its free end to the mounting portion 60. The planes 57, 59 of the shoulder sections 56, 58, also extend parallel to the axis A of the wire board mounting portion 60, and sections 56, 58 project in the same direction a distance of about 0.100 inches normal to the plane 53 of the wire connecting portion 52.

Figure 4:
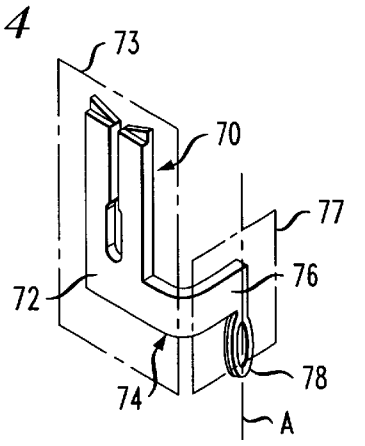
FIG. 4 is a perspective view of a third embodiment of an electrical connector terminal of the invention.

FIG. 4 shows a third embodiment of an electrical connector terminal 70 of the invention. Terminal 70 has a wire connecting portion 72 that lies within a plane 73. A shoulder portion 74 of the terminal forms a single arm 76 that projects from one side of the terminal normal to the plane 73 of the wire connecting portion 72. Arm 76 is joined at its free end to a wire board mounting portion 78. The shoulder arm 76 lies in a plane 77 that coincides with the axis A of the mounting portion 78, and the arm 76 is positioned about, e.g., 0.050 inches to the side of connecting portion 72.

Figure 5:
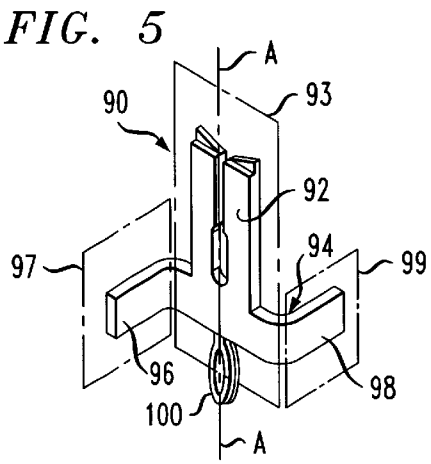
FIG. 5 is a perspective view of a fourth embodiment of an electrical connector terminal of the invention.

FIG. 5 is a view of a fourth embodiment of an electrical connector terminal 90 according to the invention. Terminal 90 has a wire connecting portion 92 that lies in a plane 93, and a shoulder portion 94 having sections 96, 98 that project from either side and in opposite directions from the wire connecting portion 92. The shoulder portion sections 96, 98 lie in planes 97, 99 which are normal to the plane 93 of the connecting portion 92. A wire board mounting portion 100 is joined at a bottom edge of the shoulder portion 94, and the axis A of mounting portion 100 coincides with an axis T of the connecting portion 92 of the terminal. Each of the planes 97, 99 of the shoulder sections 96, 98 are also parallel to the axis A of the mounting portion 100. Each section 96, 98 stands about, e.g., 0.060 inches high, and projects, e.g., about 0.080 inches from wire connecting portion 92.

Figure 6:
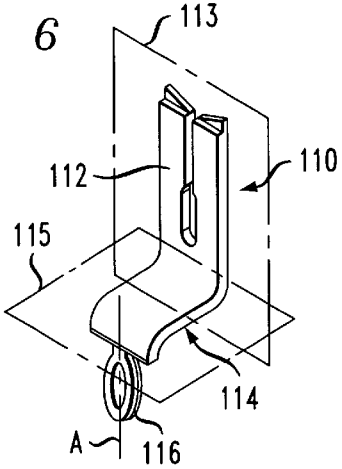
FIG. 6 is a perspective view of a fifth embodiment of an electrical connector terminal of the invention.

FIG. 6 is a view of a fifth embodiment of an electrical connector terminal 110 according to the invention. Terminal 110 has a wire connecting portion 112 that lies in a plane 113, and a shoulder portion 114 that projects normal to the plane 113 of the connecting portion. The shoulder portion 114 also lies in a plane 115 that is generally perpendicular to the axis A of a wire board mounting portion 116, the latter being joined at a free end of the shoulder portion 114 opposite the wire connecting portion 112. Ninety degree bends in the terminal 110 at either end of the shoulder portion 114 have a typical radius of, e.g., about 0.030 inches.

Figure 7:
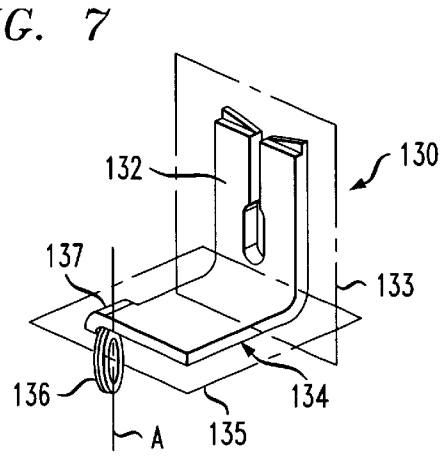
FIG. 7 is a perspective view of a sixth embodiment of an electrical connector terminal of the invention.

FIG. 7 is a view of a sixth embodiment of an electrical connector terminal 130 according to the invention. Terminal 130 has a wire connecting portion 132 that lies in a plane 133, and a shoulder portion 134 that projects normally of the plane 133 of the connecting portion 132 by a distance of, e.g., 0.100 inches. The shoulder portion 134 lies in a plane 135 that is generally perpendicular to the axis A of a wire board mounting portion 136, the latter being joined via a 90 degree bend 137 at a side corner of the shoulder portion 134 opposite the wire connecting portion 132. The width of the bend 137 may be about, e.g., 0.050 inches.

Figure 8:
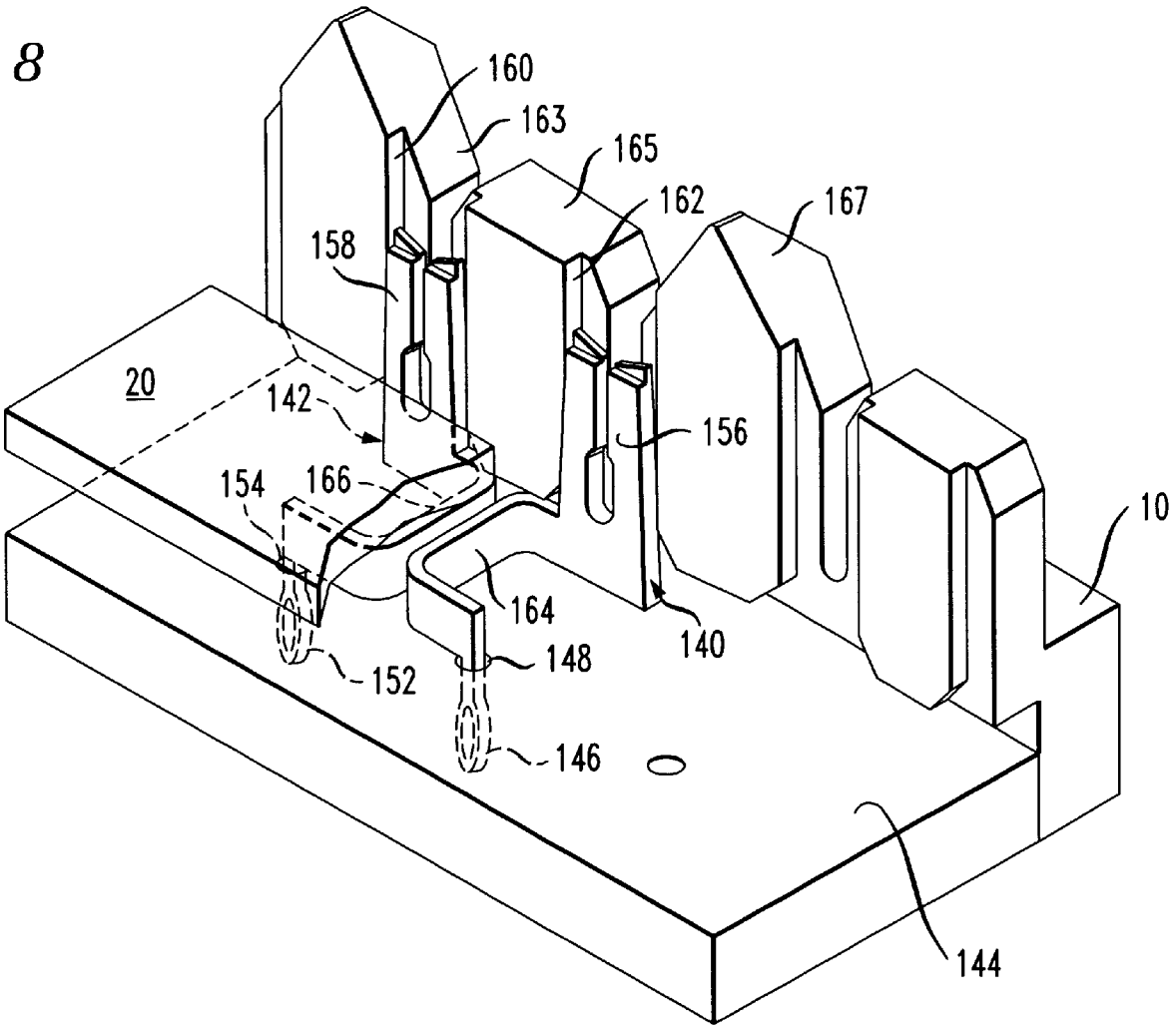
FIG. 8 is a perspective view of electrical connector terminals of the first embodiment of FIG. 2, mounted on a wire board within a terminal housing.

FIG. 8 is a view of an inside portion of the terminal housing 10 in FIG. 1, in which connector terminals 140, 142 corresponding to the first embodiment of FIG. 2 are mounted on a wire board 144. The wire board 144 is supported within the housing 10, and the base wall 20 of the housing is supported above and parallel to the wire board.

A mounting portion 146 of terminal 140 is received in a terminal opening 148 in wire board 144. Portions of the wall of opening 148 may be plated to establish electrical contact between the terminal 140 and other conductors on or within the wire board 144. Terminal 142 also has a mounting portion 152 which is received in a terminal opening 154 in the board 144.

When assembled as shown, planar wire connecting portions 156, 158 of the terminals 140, 142, are captured within corresponding channels 160, 162 formed by adjacent terminal wire guide posts 163, 165, 167. Terminals 140, 142, also have confronting shoulder portions 164, 166, whose bottom edges are substantially flush with the wire board 144, and whose top edges are restrained from upward movement by the base wall 20 of the terminal housing.

FIG. 8 shows that the present terminal construction affords stability to the terminals 140, 142 when mounted on the wire board 144. Wear or fracture at the necks of the mounting portions 146, 152 that could result from applied forces or bending moments about the mounting portions, are avoided by restraining the projecting shoulder portions 164, 166 between the wire board 144 and the base wall 20 of the terminal housing, outside the plane of the wire connecting portions 156, 158.

Due to the proximity of shoulder portions 164, 166 to one another, it will be appreciated that a degree of capacitive coupling, e.g., on the order of 1.0 picofarads, may be introduced between the terminals 140, 142, particularly where the shoulder portions are closely spaced parallel to one another using known plate capacitor formulas. In addition, due to the extended lengths of the shoulder portions, 164, 166 and their proximity to one another, mutual inductive coupling may be introduced between the shoulder portions of adjacent terminals 140, 142. Such coupling, which may typically be in the order of about 0.3 nanohenries, can operate toward reducing or compensating for crosstalk among signal paths carried by terminals 140, 142, and other terminals on the wire board 144. Capacitive or inductive coupling between shoulder portions of terminals mounted on the wire board 144, may also obviate the need for configurations of wire traces on several layers of the board, and allow the wire board to have only a single layer.

A desired amount of mutual inductance may be produced at the shoulder portions of two terminals, using known parallel plate conductor formulas. See, e.g., F. W. Grover, Inductance Calculations; Working Formulas and Tables, at page 34, where the mutual inductance M between two parallel plates of equal height, length and thickness, is given by $$M=0.002(l)[\log_e(2l/d)-\log_e k-1+d/l-d^2/4l^2]$$

where:

l=length of each plate d=plate spacing $\log_e$ is a tabulated term describing geometric mean distance Using the above formula, for a plate thickness of 0.016", height of 0.100", length of 0.200" and spacing of 0.084", M=0.3 nanohenries.

Figure 9:
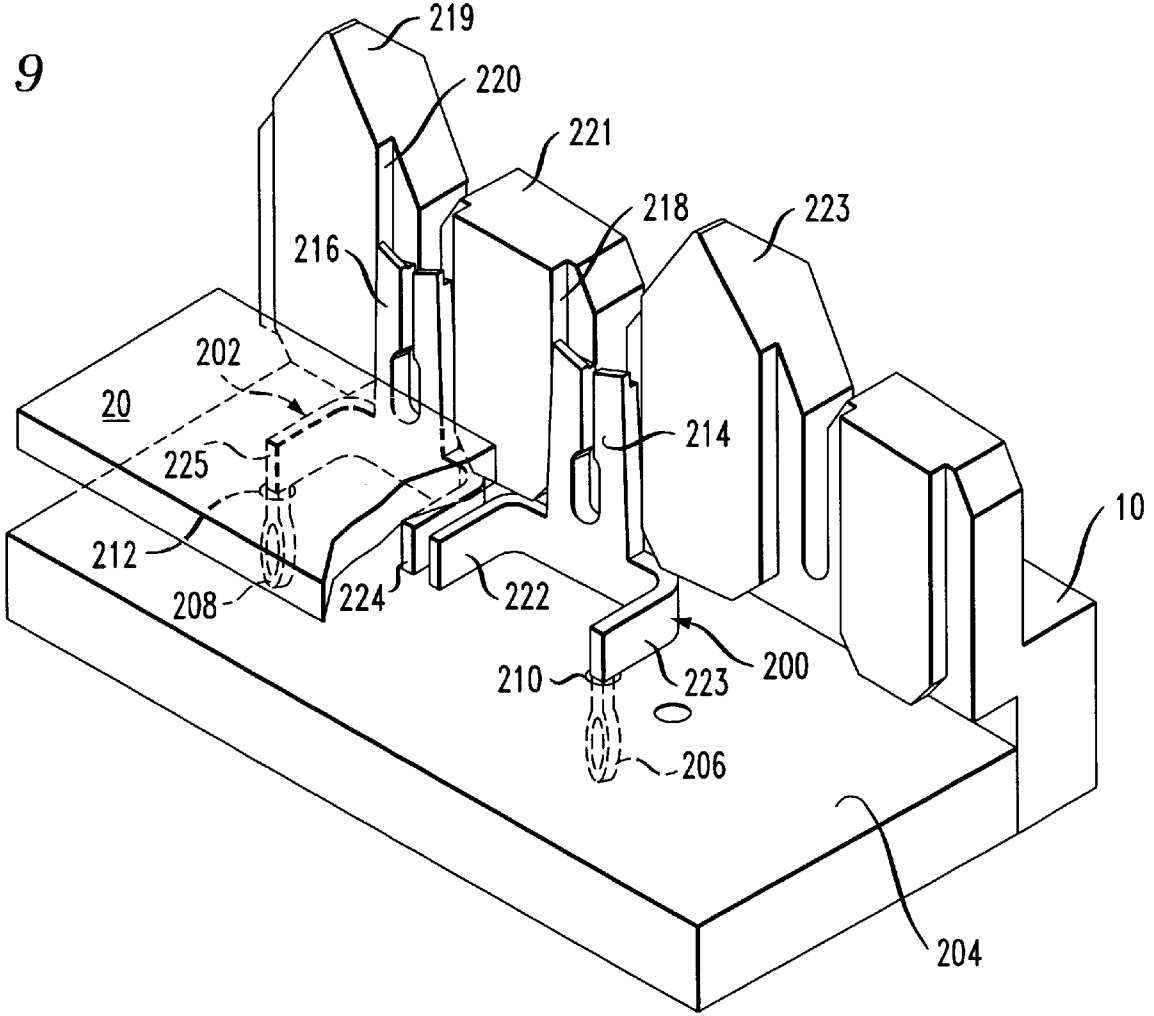
FIG. 9 is a perspective view of electrical connector terminals of the second embodiment of FIG. 3, mounted on a wire board within a terminal housing.

FIG. 9 is a view of a portion of the terminal housing 10, with connector terminals 200, 202 mounted on a wire board 204 which is supported within the terminal housing 10. The terminals 200, 202 correspond to the second connector terminal embodiment of FIG. 3. Mounting portions 206, 208 of the terminals are received in corresponding terminal openings 210, 212 in the wire board 204. The terminals have planar wire connecting portions 214, 216 that are captured within corresponding channels 218, 220 formed by terminal wire guide posts 219, 221, 223. Shoulder portions of the terminals have adjacent arms 222, 224 that are aligned parallel to one another, so that some degree of capacitive coupling may also be established between the adjacent terminals 200, 202 for purposes of crosstalk compensation or reduction. Bottom edges of the shoulder portions are substantially flush with the wire board 204, and top edges of the shoulder portions are restrained from upward movement by the base wall 20 of the terminal housing. Because mounting portions 206, 208 are joined to non-adjacent arms 223, 225 of the terminal shoulder portions, signal currents are directed through the non-adjacent arms so that substantially no inductive coupling is produced between parts of the adjacent terminals 200, 202.

Figure 10:
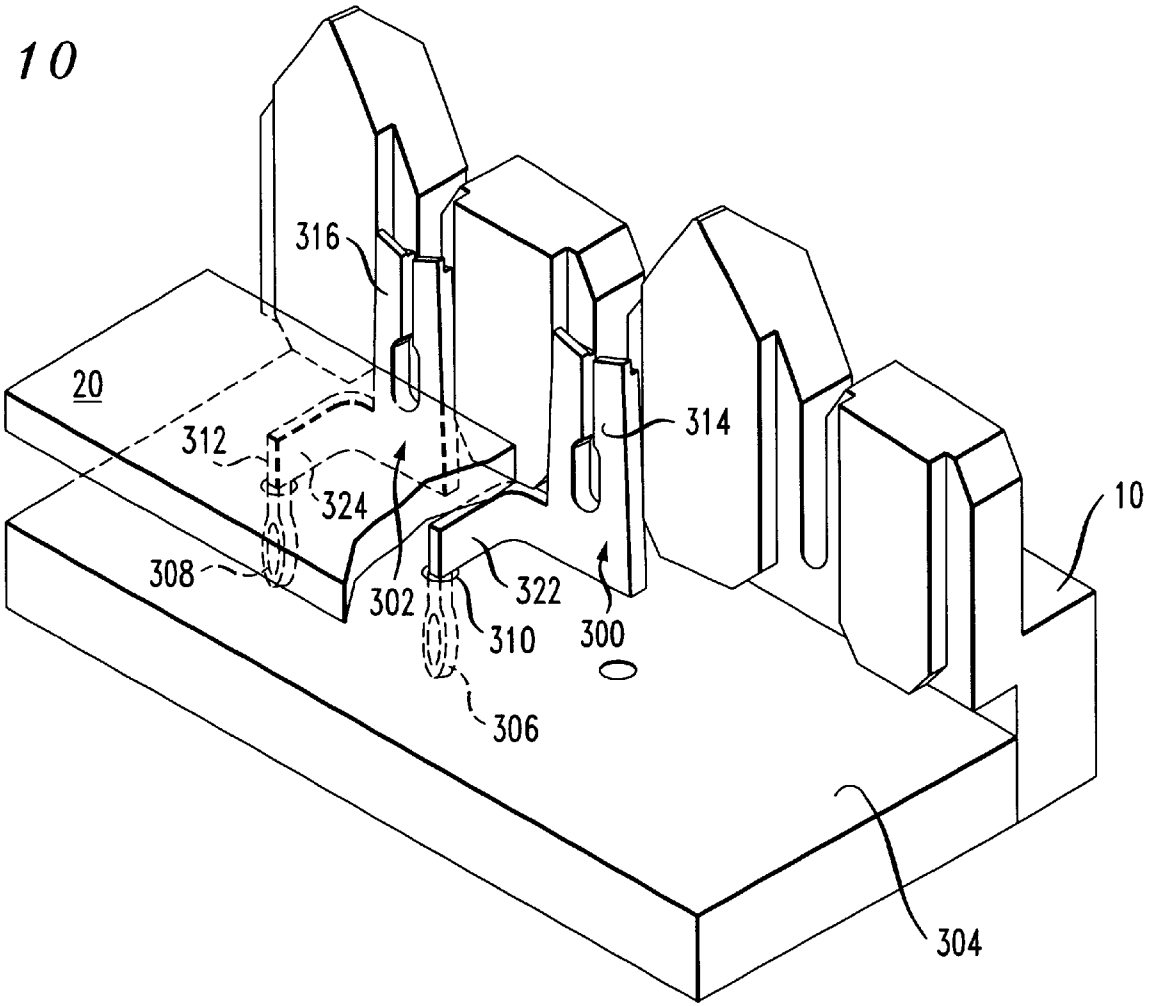
FIG. 10 is a perspective view of electrical connector terminals of the third embodiment of FIG. 4, mounted on a wire board within a terminal housing.

FIG. 10 shows connector terminals 300, 302 mounted on a wire board 304 that is supported within a portion of the terminal housing. The terminals correspond to those of the third embodiment of FIG. 4. Mounting portions 306, 308 of the terminals are received in corresponding terminal openings 310, 312 in the wire board 304. Planar wire connecting portions 314, 316 of the terminals are captured within corresponding channels 318, 320 formed by terminal wire guide posts 319, 321, 323. As shown in FIG. 10, shoulder portions 322, 324 of the terminals remain separated relatively far apart, so that the shoulder portions may not contribute significantly toward capacitive coupling between the terminals 300, 302. Bottom edges of the shoulder portions are substantially flush with the wire board 304, and top edges of the shoulder portions are restrained from upward movement by the base wall 20 of the terminal housing.

Figure 11:
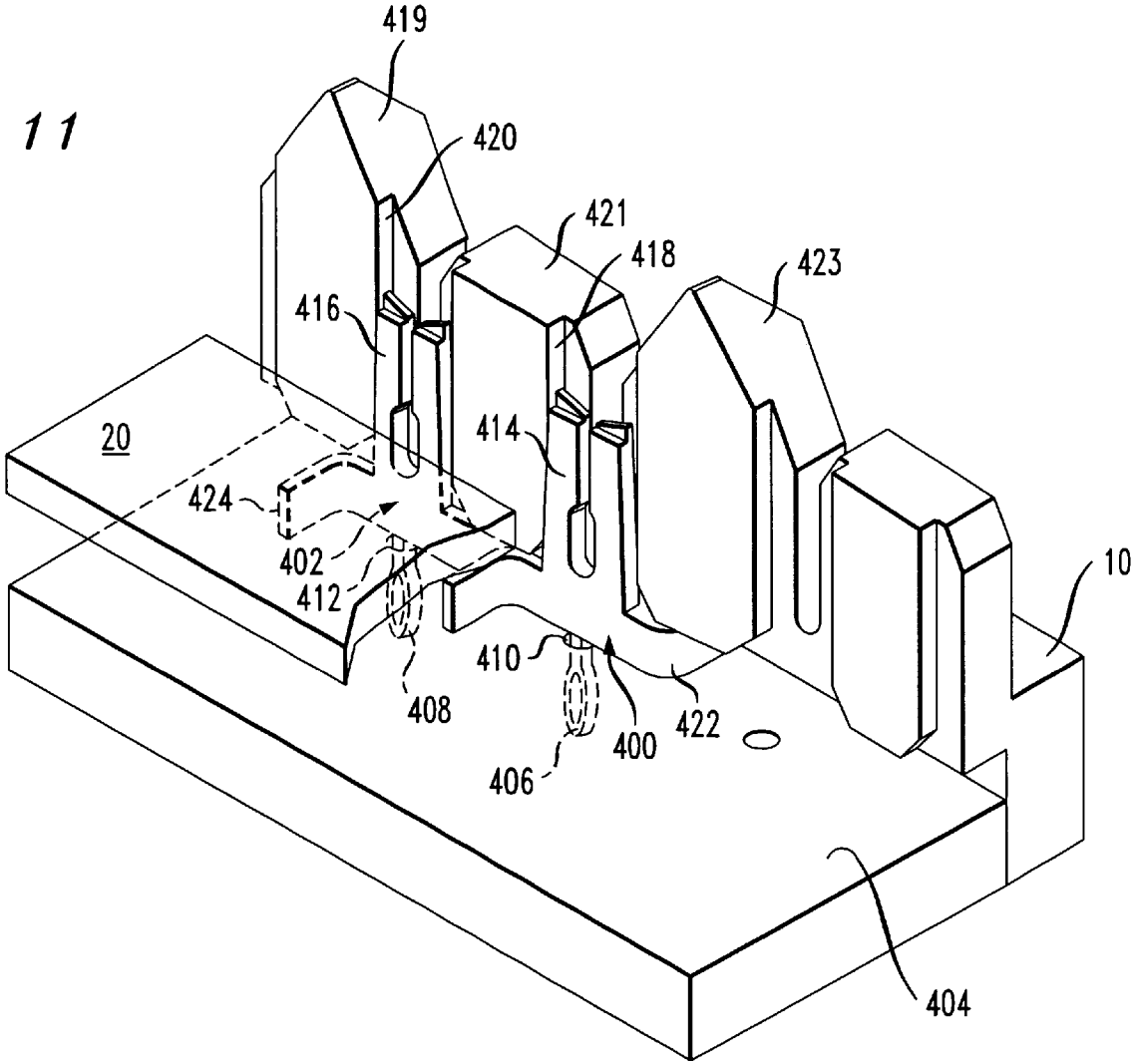
FIG. 11 is a perspective view of electrical connector terminals of the fourth embodiment of FIG. 5, mounted on a wire board within a terminal housing.

FIG. 11 shows connector terminals 400, 402 of the fourth embodiment (FIG. 5) mounted on a wire board 404 that is supported within a portion of the terminal housing 10. Mounting portions 406, 408 of the terminals are received in corresponding terminal openings 410, 412 in the board 404. Planar wire connecting portions 414, 416 are captured within corresponding channels 418, 420 formed by terminal wire guide posts 419, 421, 423. Shoulder portions 422, 424 of the terminals project normally and in opposite directions from the plane of the wire connecting portions 414, 416. Arms of the shoulder portions that extend inwardly of the housing 10 are restrained from upward movement by the housing base wall 20. The remaining arms extend beneath and are restrained by bottom surfaces of the wire guide posts over the wire board 404.

Figure 12:
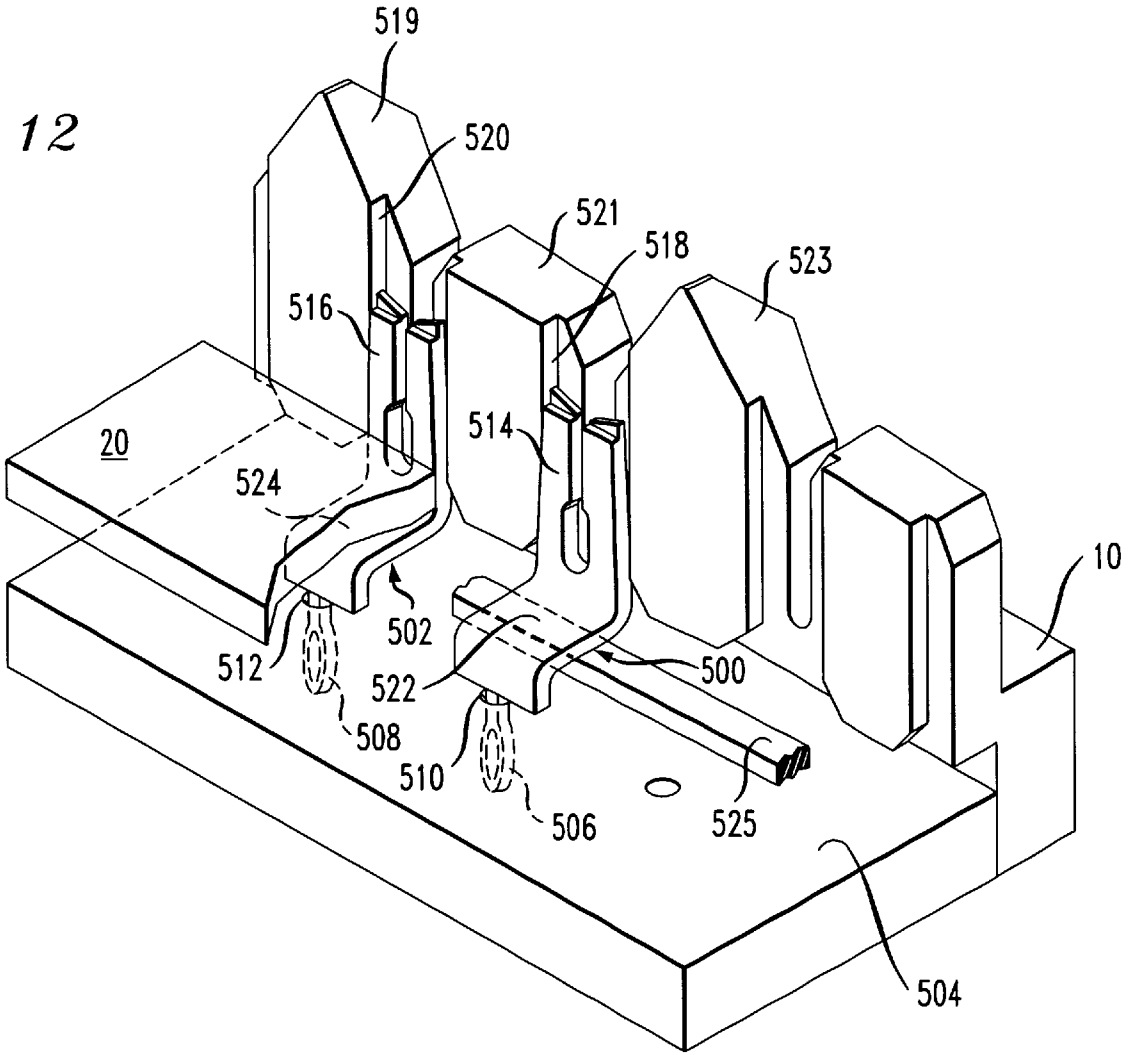
FIG. 12 is a perspective view of electrical connector terminals of the fifth embodiment of FIG. 6, mounted on a wire board within a terminal housing.

FIG. 12 is a view of electrical connector terminals 500, 502 of the fifth embodiment (FIG. 6) mounted on a wire board 504 that is assembled within a portion of the terminal housing 10. Mounting portions 506, 508 of the terminals are received in corresponding terminal openings 510, 512 in the wire board 504. Planar wire connecting portions 514, 516 are captured in corresponding channels 518, 520 formed by terminal wire guide posts 519, 521, 523. Shoulder portions 522, 524 of the terminals project in a plane that is perpendicular to the axis of the mounting portions, and are restrained from upward movement by the housing base wall 20. An insulative strip or step 525 may be disposed on the wire board directly beneath and in contact with terminal shoulder portions to restrain downward movement of the shoulder portions and their associated terminals.

Figure 13:
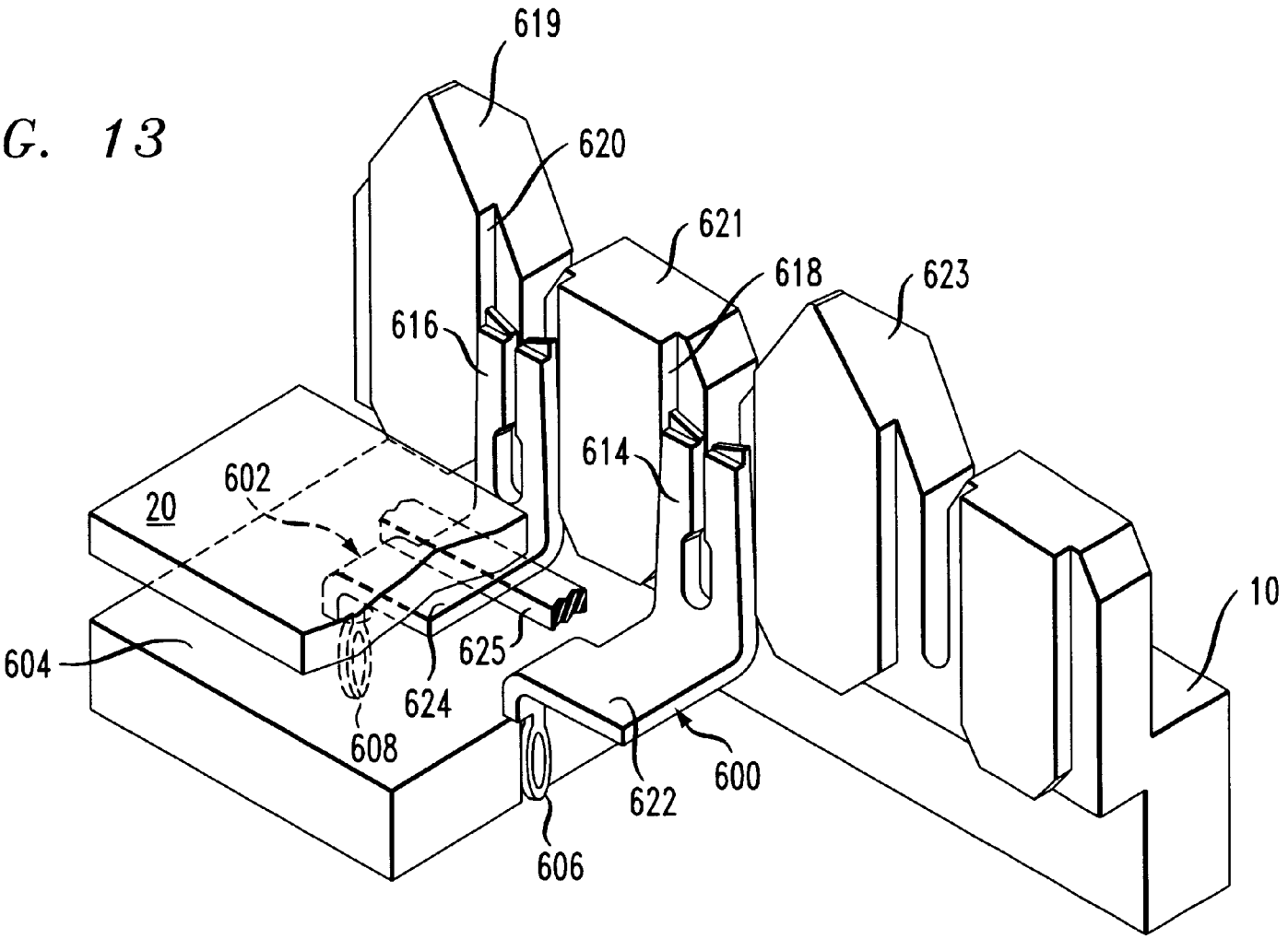
FIG. 13 is a perspective view of electrical connector terminals of the sixth embodiment of FIG. 7, mounted on a wire board within a terminal housing.

FIG. 13 is a view of connector terminals 600, 602 according to the sixth embodiment (FIG. 7) mounted on a wire board 604 that is supported within a portion of the terminal housing 10. Mounting portions 606, 608 of the terminals are received in corresponding terminal openings 610, 612 in the board 604. Wire connecting portions 614, 616 of the terminals are captured within corresponding channels 618, 620 formed by terminal wire guide posts 619, 621, 623. Shoulder portions 622, 624 of terminals 600, 602 project in a plane perpendicular to the axes of the mounting portions, and are restrained from upward movement by the base wall of the terminal housing 10. An insulative strip or step 625 may be disposed on the wire board directly beneath and in contact with the terminal shoulder portions to restrain downward movement of the shoulder portions and their associated terminals.

Figure 14:
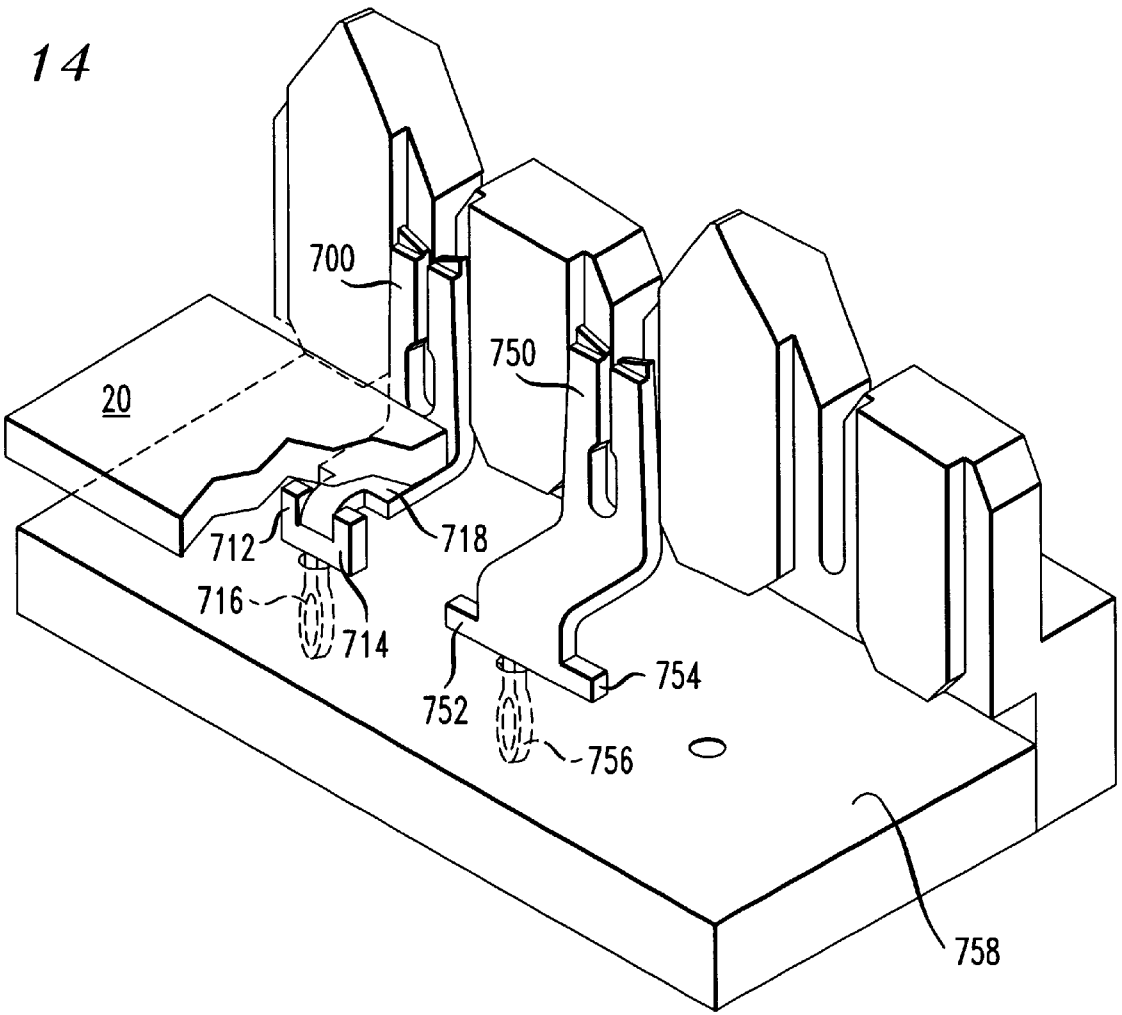
FIG. 14 is a perspective view of a modified connector terminal of FIG. 6, mounted on a wire board within a terminal housing.

FIG. 14 shows two modifications of the terminal embodiment of FIGS. 6 and 12. To obtain a larger degree of restraint by the base wall 20 of the terminal housing, terminal 700 at the left in FIG. 14 is formed to have two fingers 712, 714 that project upward from either side of the neck of the mounting portion 716. Top surfaces of the fingers 710, 714, are dimensioned to be co-planar with shoulder portion 718 of the terminal, so that both fingers 712, 714 together with the shoulder portion 718 will be disposed substantially flush with a bottom surface of the base wall 20.

Terminal 750 at the right in FIG. 14 is formed to have two fingers 752, 754 that project in-line from either side of the neck of the mounting portion 756. Bottom surfaces of the fingers 752, 754 are dimensioned to be substantially flush with the top surface of a wire board 758 on which the terminal 750 is mounted. Thus, a larger degree of restraint of the terminal 750 is provided by the wire board 758, with respect to that obtained in the embodiments of FIGS. 6 and 12.

Figure 15:
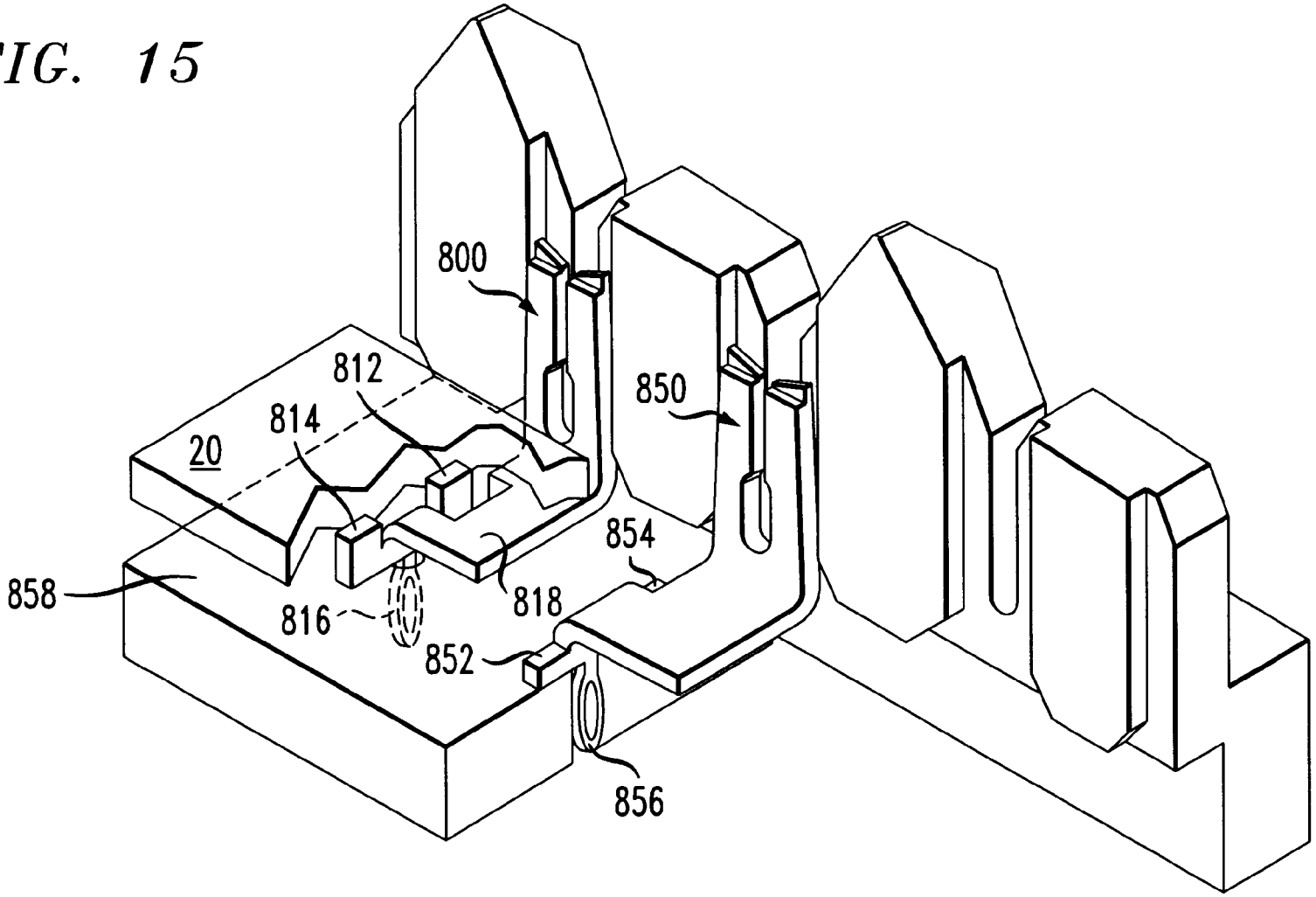
FIG. 15 is a perspective view of a modified connector terminal of FIG. 7, mounted on a wire board within a terminal housing; FIG.

FIG. 15 shows two modifications of the terminal embodiment of FIGS. 7 and 13. To obtain a larger degree of restraint by the base wall 20 of the terminal housing, terminal 800 at the left in FIG. 14 is formed to have two fingers 812, 814 that project upward from either side of the neck of the mounting portion 816. Top surfaces of the fingers 812, 814 are dimensioned to be co-planar with shoulder portion 818 of the terminal, so that both fingers 812, 814 together with the shoulder portion 818 will be disposed substantially flush with a bottom surface of the base wall 20.

Terminal 850 at the right in FIG. 15 is formed to have two fingers 852, 854 that project in-line from either side of the neck of the mounting portion 856. Bottom surfaces of the fingers 852, 854 are dimensioned to be substantially flush with the top surface of a wire board 858 on which the terminal 850 is mounted. Thus, a larger degree of restraint of the terminal 850 is provided by the wire board 858, with respect to that obtained in the embodiments of FIGS. 7 and 13.

Figure 16:
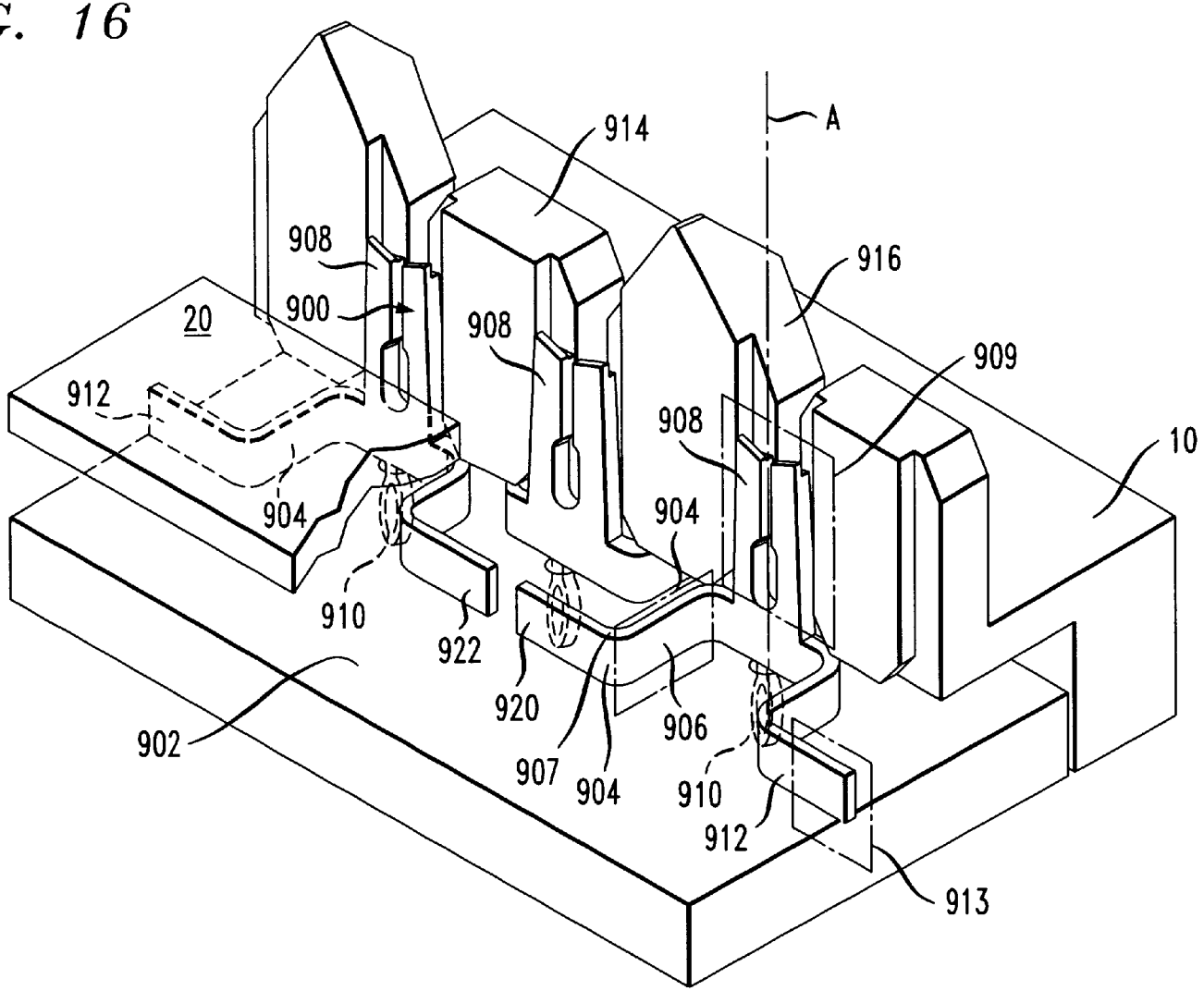
FIG. 16 is a perspective view of a seventh embodiment of an electrical connector terminal mounted on a wire board within a terminal housing.

FIG. 16 is a view of a seventh embodiment of a connector terminal 900 mounted on a wire board 902 that is supported in a portion of the terminal housing 10. Three aligned terminals 900 each have wire connecting portions 908 that lie in a plane 909. The terminals 900 also have shoulder portions 904 with first sections 906 that project in planes 907 normally of the planes 909 of the wire connecting portions 908, and wherein the planes 907 of the shoulder portion sections 906 are substantially parallel to the axes A of mounting portions 910 of the terminals. The shoulder portions 904 terminate with second sections 912 that diverge outwardly from the first sections 906 and in-line with one another in a plane 913 that is parallel to the plane 909 of the connecting portions 908. Top and bottom edges of the shoulder portions 904 of the left and right terminals 900 in FIG. 16, are restrained between the wire board 902 and the base wall 20 of the terminal housing. The shoulder portion 904 of the center terminal 900 in FIG. 16 is restrained between the wire board 902 and a bottom surface of terminal wire guide posts 914, 916 within which the center terminal 900 in FIG. 16 is captured. Some capacitive coupling between confronting ends 920, 922 of the second shoulder portion sections 912 of the non-adjacent left and right-most terminals 900 in FIG. 16, may be produced for the purpose of reducing or compensating for crosstalk among signal paths carried by the non-adjacent terminals 900.

Figure 17:
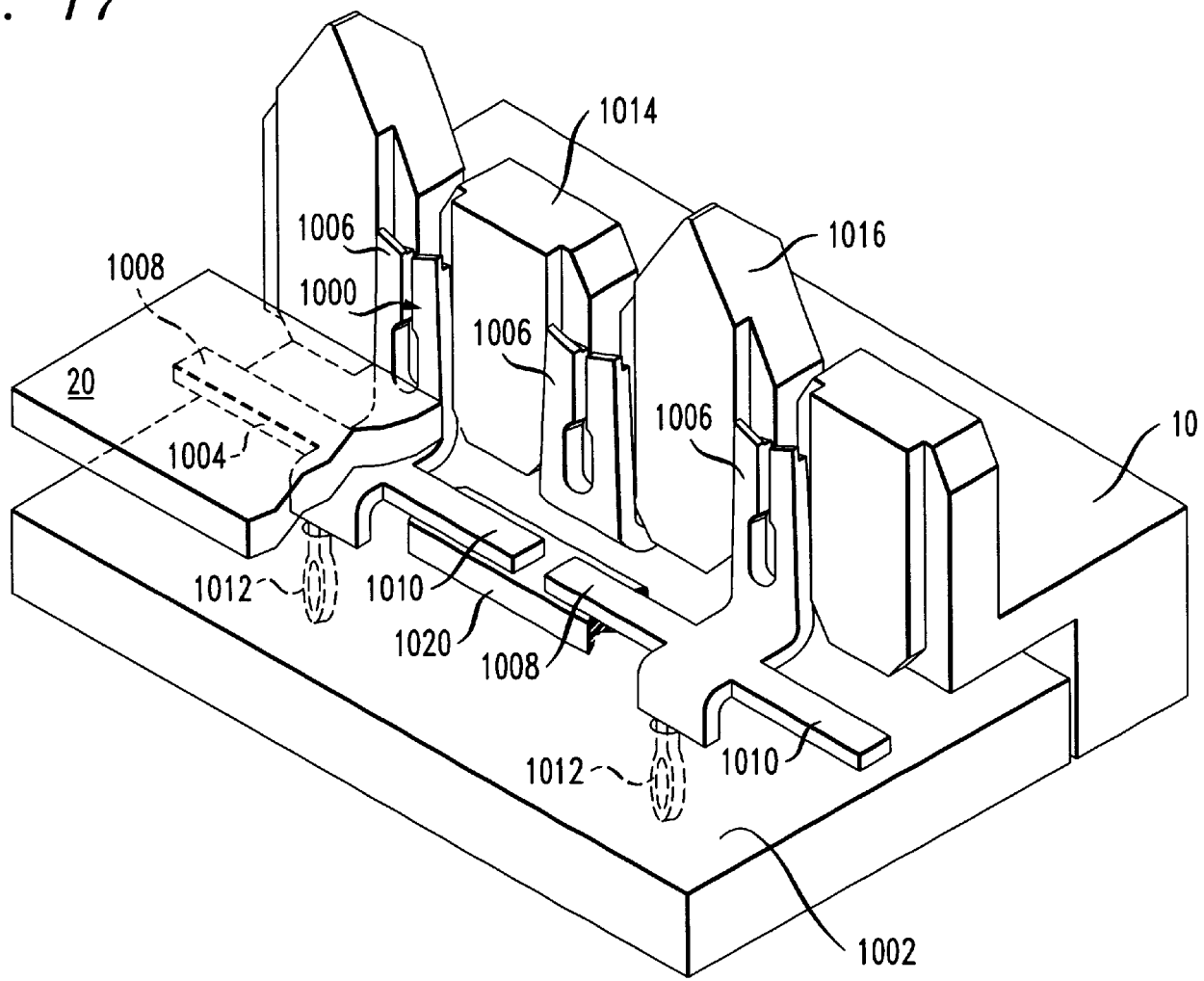
FIG. 17 is a perspective view of an eighth embodiment of an electrical connector terminal mounted on a wire board within a terminal housing.

FIG. 17 is a view of an eighth embodiment of a connector terminal 1000 mounted on a wire board 1002 that is supported within a portion of the terminal housing 10. Shoulder portions 1004 of three aligned terminals 1000 project normally of wire connecting portions 1006, and are formed with elongated flat finger sections 1008, 1010 that extend in-line from either side of terminal mounting portions 1012. The shoulder portions 1004 including the finger portions 1008, 1010 extend in a plane substantially perpendicular to the axes of the mounting portions 1012.

The left and right terminals in FIG. 17 are mounted so that the finger sections 1008, 1010 will be disposed substantially flush with a bottom surface of the base wall 20 of the terminal housing 10, thus restraining movement of the two terminals 1000 upwardly. The center terminal 1000 in FIG. 17 is mounted so that the flat finger sections of its shoulder portion are disposed substantially flush with a bottom surface of terminal wire guide posts 1014, 1016 within which the center terminal 1000 is captured. Upward movement of the center terminal 1000 is thus restrained by the bottom surface of the guide posts acting against the finger sections 1008, 1010 of the of the terminal. An insulative strip or step 1020 may be disposed on the wire board directly beneath and in contact with the terminal shoulder portions to restrain downward movement of the shoulder portions and their associated terminals. Some capacitive coupling between confronting finger section 1010 of the left-most terminal 1000 in FIG. 17, and the finger section 1008 of the right-most, non-adjacent terminal 1000, may be produced to reduce or compensate for crosstalk among signal paths carried by the non-adjacent terminals 1000.

While the foregoing description represents preferred embodiments of the invention, it will be obvious to those skilled in the art that various changes and modifications may be made, without departing from the spirit and scope of the invention pointed out by the following claims.

We claim:

1. An electrical connector terminal, comprising:

an elongated wire board mounting portion having an axis, wherein the mounting portion is formed to fit axially in a terminal opening in a wire board;

an elongated generally planar wire connecting portion having an axis the same as the axis of the mounting portion and formed to connect electrically with an outside wire lead; and a shoulder portion formed between the mounting portion and the wire connecting portion, wherein the shoulder portion has a first section that extends from a base of the wire connecting portion in a direction normal to the wire connecting portion so that the terminal will be held stably relative to the wire board when the first section of the shoulder portion is restrained by an outside part at a position outside the plane of the wire connecting portion;

the shoulder portion has a second section that diverges from an end of the first section farther from the wire connecting portion, and the second section extends in a direction that is parallel to the wire connecting portion; and an end of the second section of the shoulder portion is dimensioned and arranged to provide a desired amount of coupling in association with a confronting end of a second section of a shoulder portion of a like connector terminal.

2. A terminal according to claim 1, wherein said mounting portion, said wire-connecting portion and said shoulder portion are formed integrally from a sheet of metallic material.

3. A terminal according to claim 1, wherein said wire-connecting portion has an insulation displacement connector (IDC) configuration.

4. A terminal according to claim 1, wherein said mounting portion has two opposed curvilinear sections forming an elongated, open needle-eye configuration about the axis of the mounting portion.

5. An electrical connector terminal arrangement, comprising:

a wire board; and at least a first connector terminal and a second connector terminal mounted on the wire board, wherein each terminal includes:

an elongated wire board mounting portion having an axis, wherein the mounting portion is formed to fit axially in a terminal opening in the wire board;

a wire connecting portion formed to lie in a first plane which coincides with the axis of the mounting portion, and the connecting portion is formed to connect electrically with an outside wire lead; and a shoulder portion joined between the mounting portion and the wire connecting portion, wherein the shoulder portion has a first section that extends in a second plane parallel to the axis of said mounting portion and which is normal to the first plane of the wire connecting portion so that the terminal will be held stably relative to the wire board when the first section of the shoulder portion is restrained by an outside part at a position outside the first plane of the wire connecting portion;

the shoulder portion has a second section that diverges from the first section and extends in a third plane that is parallel to the first plane of the wire connecting portion, and an end of the second section of the shoulder portion of the first terminal is aligned with and spaced from an end of the second section of the shoulder portion of the second terminal to obtain a desired coupling between the first and the second connector terminals.

6. An electrical connector terminal arrangement according to claim 5, wherein said mounting portion, said wire-connecting portion and said shoulder portion are formed integrally from a sheet of metallic material.

7. A terminal arrangement according to claim 5, wherein said wire-connecting portion has an insulation displacement connector (IDC) configuration.

8. An electrical connector terminal arrangement according to claim 5, wherein said mounting portion has two opposed curvilinear sections forming an elongated, open needle-eye configuration about the axis of the mounting portion.

9. An electrical connector terminal block, comprising:

a housing;

a wire board supported in the housing;

a base wall supported in the housing in the vicinity of the wire board;

a first connector terminal and a second connector terminal mounted on the wire board, wherein each of the first and the second connector terminals includes:

an elongated wire board mounting portion having an axis, wherein the mounting portion is formed to fit axially in a terminal opening in the wire board;

an elongated generally planar wire connecting portion having an axis the same as the axis of the mounting portion and formed to connect electrically with an outside wire lead; and a shoulder portion formed between the mounting portion and the wire connecting portion, wherein the shoulder portion has a first section that extends from a base of the wire connecting portion in a direction normal to the wire connecting portion, so that the first and the second connector terminals are held stable relative to the wire board when the first section of the shoulder portion of each terminal is restrained by said base wall at a position outside the plane of the wire connecting portion of each terminal;

the shoulder portion of each terminal has a second section that diverges from an end of the first section farther from the wire connecting portion, and the second section extends in a direction that is parallel to the wire connecting portion; and an end of the second section of the shoulder portion of the first terminal is aligned with and spaced from an end of the second section of the shoulder portion of the second terminal in such a manner as to obtain a desired coupling between the first and the second connector terminals.

10. An electrical connector terminal block according to claim 9, including a third connector terminal mounted on the wire board and aligned between the first and the second connector terminals.

11. An electrical connector terminal block according to claim 10, wherein the third connector terminal also has said wire board mounting portion, said wire connecting portion, and said shoulder portion.

12. An electrical connector terminal block according to claim 9, including terminal wire guide posts formed on said housing, wherein the guide posts have channels for receiving the wire connecting portions of the first and the second connector terminals.

13. An electrical connector terminal block according to claim 11, including terminal wire guide posts formed on said housing, wherein the guide posts have channels for receiving the wire connecting portions of the first, the second, and the third connector terminals, and the shoulder portion of the third connector terminal is restrained by a bottom surface of the terminal wire guide posts.

* * * * *